US010767947B2

(12) United States Patent
Marshall

(10) Patent No.: US 10,767,947 B2
(45) Date of Patent: Sep. 8, 2020

(54) APPARATUS AND METHOD FOR LOADING AMMUNITION MAGAZINES

(71) Applicant: David Clive Marshall, Niederkruechten (DE)

(72) Inventor: David Clive Marshall, Niederkruechten (DE)

( * ) Notice: Subject to any disclaimer, the term of this patent is extended or adjusted under 35 U.S.C. 154(b) by 0 days.

(21) Appl. No.: 16/536,630

(22) Filed: Aug. 9, 2019

(65) Prior Publication Data

US 2020/0003510 A1 Jan. 2, 2020

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84; F41A 9/06; F41A 9/24; F41A 9/25; F41A 9/37; F42B 39/26; F42B 39/22
USPC ..... 42/87, 88; 89/33.01, 33.1, 34
See application file for complete search history.

(56) References Cited

U.S. PATENT DOCUMENTS 452,447 A * 5/1891 Bruce ..... F41A 9/84 42/88
1,178,785 A * 4/1916 Debuchy ..... F41A 9/83 42/87
2,345,031 A * 3/1944 Carithers ..... F41A 9/68 42/18
2,402,195 A * 6/1946 Woodberry ..... F42B 39/10 86/45
3,014,618 A * 12/1961 Kireta ..... F42B 39/002 221/298
3,138,287 A * 6/1964 Kireta ..... F42B 39/002 221/94
3,332,594 A * 7/1967 De Capua ..... F42B 39/02 221/185
3,845,889 A * 11/1974 Hurd ..... F42B 39/02 221/185
4,706,402 A * 11/1987 Csongor ..... F41A 9/84 42/87
4,707,941 A * 11/1987 Eastman ..... F41A 9/68 42/49.02
5,046,639 A * 9/1991 Deberry ..... A47F 1/10 221/127
6,799,500 B1 * 10/2004 Kulikowski ..... F41A 9/79 89/1.1
9,574,836 B1 2/2017 Cauley, Jr. et al.
(Continued)

FOREIGN PATENT DOCUMENTS

CN 105627817 6/2016

OTHER PUBLICATIONS

Albright IP, Bronze Patent Search Report: "Marshall Loader", dated Feb. 27, 2019, Gloucestershire, UK.

*Primary Examiner* — Derrick R Morgan
(74) *Attorney, Agent, or Firm* — Marin Cionca; Cionca IP Law P.C.

(57) ABSTRACT

An apparatus and method for loading ammunition magazines that allows for loading in an efficient and fast manner, proper storage of ammunition and limited, if any, contact between the user and the lead coating of the ammunition. The apparatus relieves thumb fatigue and blisters due to the circular indent that depresses the button on the magazine. The apparatus is also designed to prevent fouling because of the lack of contact between the wax and residue of the bullet and the mechanical device.

19 Claims, 11 Drawing Sheets

(56) References Cited

U.S. PATENT DOCUMENTS

| | | | | |
|---|---|---|---|---|
| 9,772,152 | B1 | 9/2017 | Niccum | |
| 9,995,548 | B1 * | 6/2018 | Zhou | F41A 9/83 |
| 10,132,582 | B1 * | 11/2018 | Zhou | F41A 9/83 |
| 2012/0255211 | A1 | 10/2012 | Kim | |
| 2013/0067788 | A1 * | 3/2013 | Gray | F41A 9/84<br>42/88 |
| 2013/0206787 | A1 * | 8/2013 | Shiell | F42B 39/002<br>221/279 |
| 2014/0317985 | A1 | 10/2014 | Cauley, Jr. et al. | |
| 2015/0176934 | A1 * | 6/2015 | Shaskan | F42B 39/26<br>89/33.1 |
| 2017/0030669 | A1 | 2/2017 | Kim | |
| 2018/0216905 | A1 * | 8/2018 | Lamarche | F41A 9/83 |
| 2020/0003510 | A1 * | 1/2020 | Marshall | F41A 9/83 |
| 2020/0124390 | A1 * | 4/2020 | Albuquerque | F42B 39/26 |

* cited by examiner

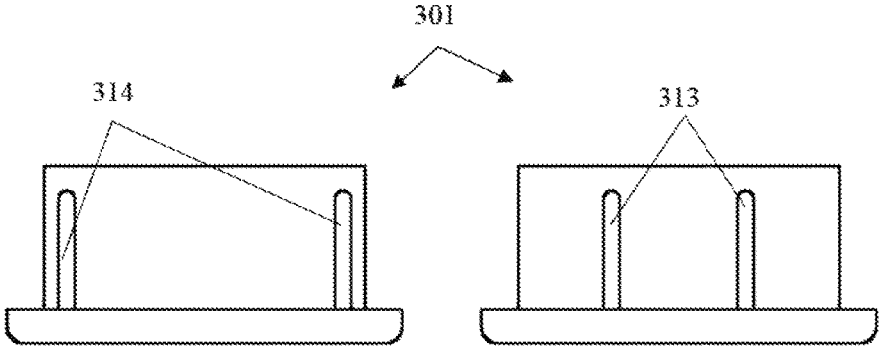
FIG. 3a
FIG. 3b
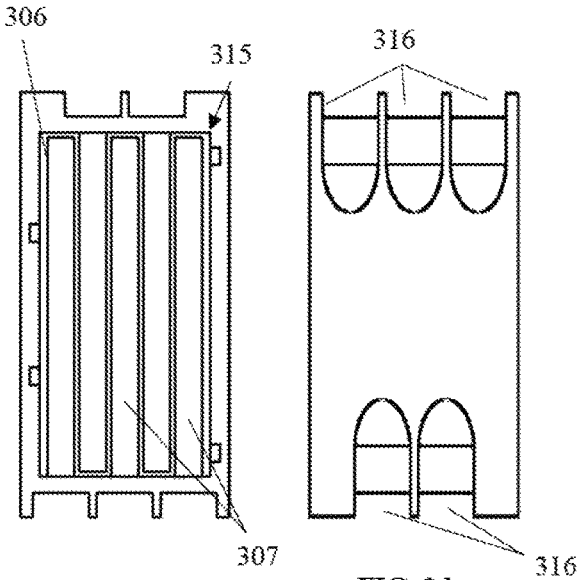
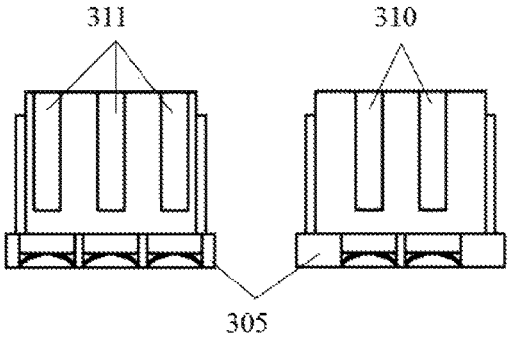
FIG. 3c
FIG. 3d
FIG. 3e
FIG. 3f

APPARATUS AND METHOD FOR LOADING AMMUNITION MAGAZINES

BACKGROUND OF INVENTION

1. Field of the Invention

The invention relates generally to firearms and more specifically to apparatus and method for loading magazines in an efficient manner with limited contact between the user and the rounds.

2. Description of the Related Art

Ammunition loading is a tedious task that requires dexterity and the willingness to have bruised and/or blistered thumbs due to the nature of the existing magazine loading procedures and mechanisms. Another issue is due to the ammunition being made from lead, which is toxic to humans, meaning gloves or the willingness to come into contact with the toxic material are required for loading the magazine. Other magazine loaders are catered to push fit magazines, meaning that there needs to be a mechanical forcing of the ammunition into the magazine, which can cause wear on the magazine loader. Loading is also a time-consuming and unorganized process that limits the amount of time spent firing the gun. Therefore, there is a need to solve the problems described above by proving a device and method for efficient and safe loading of magazines.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a device for loading ammunition in a magazine is provided, the device having a slide housing, that houses the ammunition in the appropriate amount for each magazine, holds each round by its rim to prevent contact between the lead portion of the bullet and the device, and reduces friction between the device and the rounds, a main housing, which holds the rounds in position within the slide housing by the use of retention caps and readies them for loading, and a magazine holder, that depresses the magazine button to allow for accelerated loading of a full magazine at once. Thus, an advantage is not being in contact with the toxic lead casing of the ammunition along with a lack of fouling on the device from the wax or lead.

Another advantage is the user no longer having to depress the magazine button manually because depressing the button manually for an extended period of time can lead to finger fatigue or even blisters. This also allows the ammunition to easily slide into the magazine without any mechanical force because the rounds slide into the open magazine using gravity. Another advantage is the time saved by using this device. In an example, the device allows for five magazines at a total of fifty round capacity be loaded within thirty seconds and then allowing the loader to be ready to be used again within a ten second window. Overall, this allows the user to have more time firing the firearm instead of time spent tediously loading each magazine.

In another aspect, the apparatus for loading magazines can also be used to store ammunition in a compact manner. Not properly stored ammunition can lead to the bullets being damaged or in the worst case can lead to them discharging and causing a chain reaction in the container they are being stored in. Furthermore, firearms enthusiasts typically keep bullets loose inside their housings or loose for manual loading on the range. Thus, another advantage is that the ammunition can be stored safely within the loading apparatus. In an example, the loading apparatus, when filled, can be stood on by a grown man weighing in excess of 100 kg and the container will still exert no pressure to the rounds inside, which means the round will not unintentionally discharge. Another advantage is its compact size due to the magazine housing being detachable. The detachability of the magazine holder also makes the apparatus more universal to the possibility of different magazine shapes.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which:

FIG. 3*a* illustrates a back view of the slide housing, according to an aspect.

FIG. 3*b* illustrates a front view of the slide housing, according to an aspect.

FIG. 3*c* illustrates a top view of the slide housing, according to an aspect.

FIG. 3*d* illustrates a bottom view of the slide housing, according to an aspect.

FIG. 3*e* illustrates a right side view of the slide housing, which show the bullet channels and the three-ammunition exit configuration, according to an aspect.

FIG. 3*f* illustrates a left side view of the slide housing, which show the bullet channels and the two-ammunition exit configuration according to an aspect.

DETAILED DESCRIPTION

Figure 1:
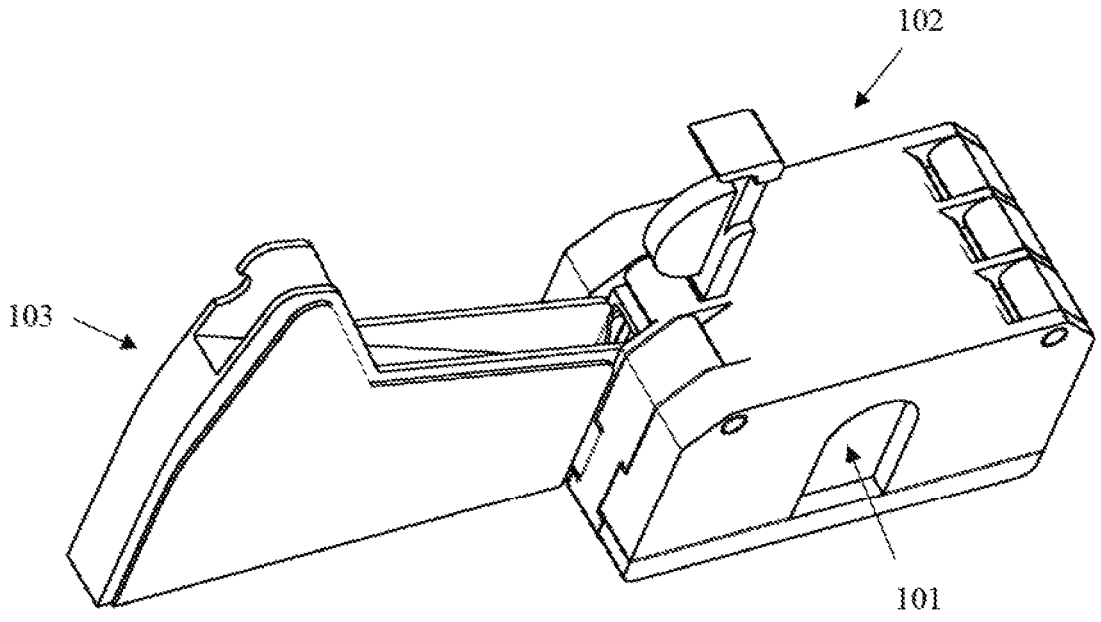
FIG. 1 illustrates a perspective view of a device for loading ammunition into a magazine, more specifically showing three loading components namely a slide housing, a main housing, and a magazine holder, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the perspective view of a device for loading ammunition in a magazine showing three loading components namely the slide housing 101, main housing 102, and magazine holder 103, according to an aspect. As it will be described in more detail hereinafter, these three loading components cooperate to expediently and safely load a magazine.

Figure 2:
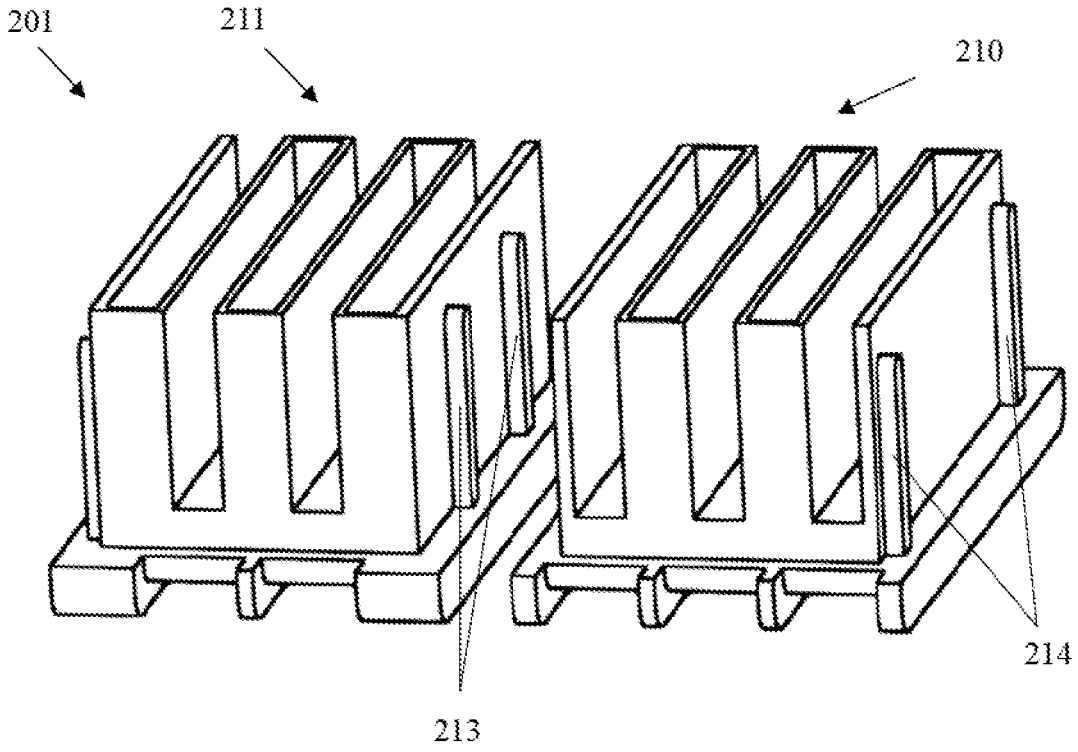
FIG. 2 illustrates a perspective view of a slide housing in two orientations, according to an aspect.

FIG. 2 illustrates the left and right perspective views of a slide housing 201, according to an aspect. The slide housing has two sides 210 and 211 with ammunition exits to allow the bullets to leave the slide housing as shown in FIG. 3*d*-3*f*, and as it will be described when referring to FIG. 3*d*-3*f* The male thin-span key protrusions 213 and male wide-span key protrusions 214, as it will be described when referring to FIG. 3*a*-3*c*, allow the slide housing 201 to engage with the main housing 102, as it will be described when referring to FIG. 9*c*. In an example, instead of a mechanical lock, magnets may be used to engage the slide housing 201 with the main housing 102 and the magnets may be made of neodymium because of their thin structure and may be flush with the main housing 102. However, in time magnets could fail and thus could pose a hazard to the user by accidently opening the delivery assembly.

Figure 9A:
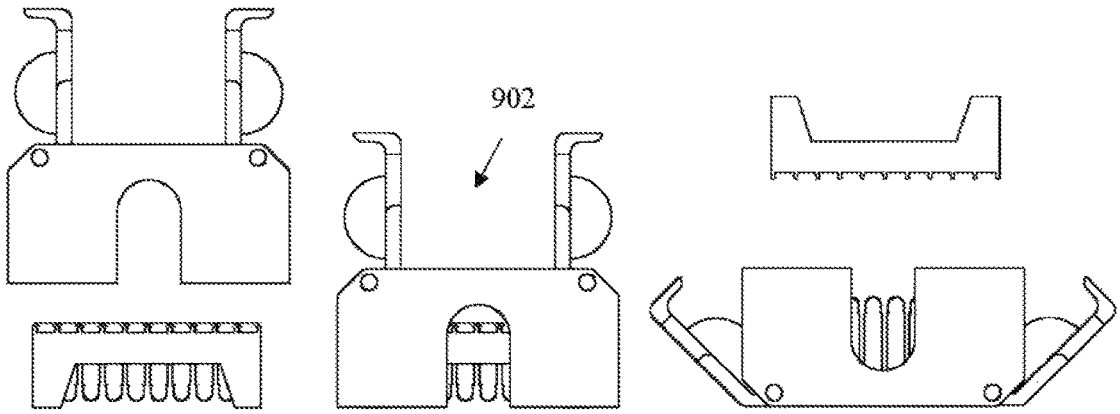
FIG. 9*a* illustrates a front view of the main housing being loaded with a box of ammunition, according to an aspect.

FIG. 3*a* illustrates a back view of the slide housing 301, which as shown has a set of exterior male wide-span key protrusions 314, according to an aspect. The corresponding configuration, specifically the female keyways 529 on the main housing 102 allow for the slide housing 301 and the main housing 102 to be orientated only in the correct alignment, which is as shown in FIG. 9*c*, and as it will be described when referring to FIG. 9*c*.

FIG. 3*b* illustrates a front view of the slide housing 301, which as shown has an exterior set of male thin-span key protrusions 313, according to an aspect. As will be described in more detail hereinafter when referring to FIG. 9*c*, the corresponding configurations, specifically female keyways 523 on the main housing 102 allow for the slide housing 301 and the main housing 102 to be orientated only in the correct alignment, which is shown in FIG. 9*c*, and it will be described more when referring to FIG. 9*c*.

FIG. 3*c* illustrates a top view of the slide housing 301, which as shown is formed by a zig zag pattern 315 and rails 306 creating a channel 307 for containing the ammunition, and both a set of exterior wide-span 314 and thin-span 313 protrusions, according to an aspect.

FIG. 3*d* illustrates a bottom view of the slide housing, according to an aspect. The slide housing 301 also includes hook points, or notches 316 for the retention caps to engage the slide housing 301 to the main housing 102. This engagement between the slide housing 301 and the main housing 102 ensures a secure connection via the retention caps being able to grip the slide housing notch 316 when in the locked position. These notches 316 are aligned with each channel ammunition exit 307 to allow the retention caps to operationally engage with the slide housing 301, thus providing a locked engagement and alignment with the slide housing 301 and the main housing 102. The retention caps may engage with the slide housing notches 316 which act as a mechanical lock, to provide the secure connection between the slide housing 301 and the main housing 102. In an example, the notches 316 allow for the delivery assembly 981 to be securely engaged at all times when a minimum of one retention cap may be in the closed position. As an example, the slide housing 301 may have grooves for the finger of the user to easily and ergonomically open the retention caps from the bottom of the slide housing 301.

Figure 4:
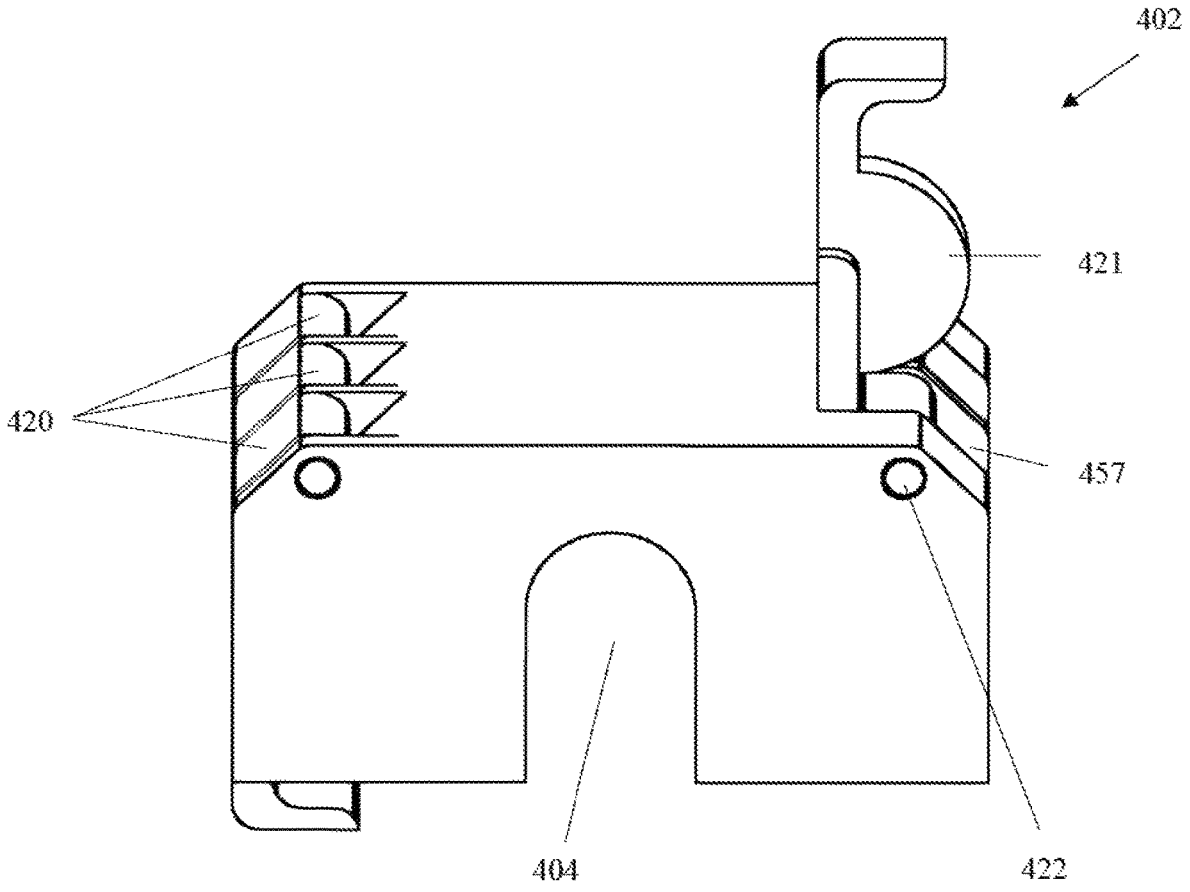
FIG. 4 illustrates the perspective view of a main housing, according to an aspect.

FIG. 3*e* illustrates a right side view of the slide housing 301, which show the bullet channels 307 and the three-ammunition openings 311 configuration, according to an aspect. FIG. 3*f* illustrates a left side view of the slide housing 301, which show the bullet channels 307 and the two-ammunition opening 310 configuration, according to an aspect. As shown in FIGS. 3*c*-3*f*, each channel 307 alternates its ammunition exits 310, 311 from the immediately adjacent channel 307, such that two of the ammunition exits depicted as 310 are on one side and the remaining three of the ammunition exits depicted as 311 are on the opposite side of the slide housing 301. FIG. 3*e* and FIG. 3*f* also show the bottom plate 305, which allows the slide housing 301 to be easily removed from the main housing 102 by using the thumb recess 404, which is as shown in FIG. 4, and as it will be described when referring to FIG. 4. The channels 307 allow each row of ammunition to be completely independent within the system, such that to slide out of the channels 307 without affecting the ammunition within the other channels 307.

FIG. 4 illustrates the perspective view of a main housing 402, which is an exterior container with two or three retention caps 420 on each side respectively along with a cutout (thumb recess) 404 for access to the interior components on the front and back sides, according to an aspect. The main housing 402 allows for the ammunition to be easily loaded from the manufacturers box to the housing itself as described below when referring to FIG. 9*a*. The main housing 402 attaches to the slide housing 101 by the interior keyholes, which is as shown in FIG. 5*e*, and as it will be described when referring to FIG. 5*e*. The main housing 402 contains retention caps 420 which allow for the ammunition to leave the fully assembled unit only when the user desires.

Figures 6A, 6B:
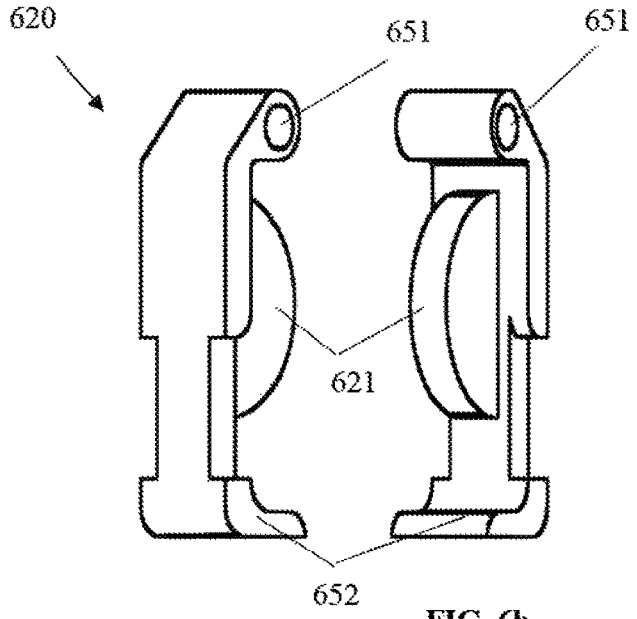
FIG. 6*a* illustrates the perspective view of the back of a retention cap, further showing a lifting lip, and a hinge pin hole, according to an aspect.
FIG. 6*b* illustrates the perspective view of the front of a retention cap, further showing a lifting lip, a protrusion, and a hinge pin hole, according to an aspect.
Figures 6C, 6D, 6E, 6F:
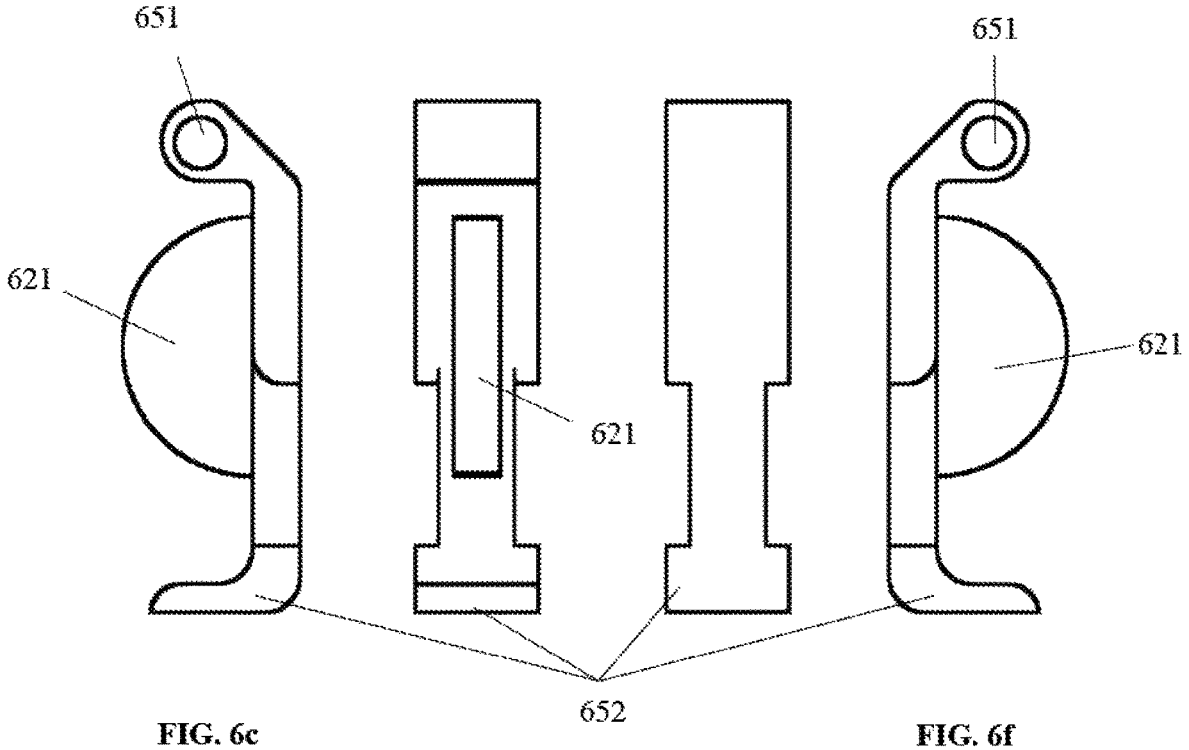
FIG. 6*c* illustrates the left side view of a retention cap, according to an aspect.
FIG. 6*d* illustrates the back view of a retention cap, according to an aspect.
FIG. 6*e* illustrates the front view of a retention cap, according to an aspect.
FIG. 6*f* illustrates the right side view of a retention cap, according to an aspect.

The retention caps 420 also contain a protrusion 421 for snuggly fitting into the exterior ammunition opening, which is as shown in FIG. 6*b*, and as it will be described when referring to FIG. 6*b*, further ensuring the rounds stay within the housing. As shown in FIG. 4, in order to hold the retention caps 420 pivotally connected to the main housing 402, a hinge pin 422 may be used to pass through each retention cap 420 and the main housing 402 on each side of the main housing 402. The cutout, or thumb recess 404, may be used for holding the manufacturer's ammunition retention casing in place during the process of loading the bullets into the main housing 402, which is as shown in FIG. 9*a*, and as it will be described when referring to FIG. 9*a*. The main housing 402 also contains a retention cap cutout 457. The retention cap cutout 457 is the hollowed-out portion on the main housing 402 underneath each retention cap 420.

Figure 5A:
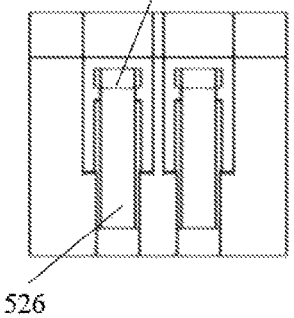
FIG. 5*a* illustrates a left side view of the main housing with the two-ammunition opening configuration, according to an aspect.

FIG. 5*a* illustrates a left side view of the main housing 102 with the three-ammunition opening 510 configuration, where each ammunition opening is comprised of a slot 526, being the larger gap for the length of the ammunition to pass through, and the rail 525, being the top portion where the rim of the bullet would rest on for the bullet to pass through, according to an aspect. Similarly, FIG. 5*c* illustrates a right side view of the main housing 102 with the three-ammunition opening 511 configuration, where each ammunition opening is comprised of a slot 526, being the larger gap for the length of the ammunition to pass through, and the rail 525, being the top portion where the rim of the bullet would rest on for the bullet to pass through, according to an aspect. A single ammunition opening 524 is shown, this shape allows the bullet to be able to slide through the space without a large amount of contact on the component. The rail 525 shows the segment for which the ammunition rests on to allow the minimum contact. The slot 526 is the larger empty space that the remaining casing of the bullet would pass through, this shape is bigger than the actual casing to limit the amount of contact, which further decreases fouling along with friction between the bullet and the housing allowing for better sliding into the magazine. The limited contact between the bullet, channel 307, and ammunition opening 524 means less lead particles being transferred, which decreases risk of particles becoming in contact with the user's skin.

Figure 5B:
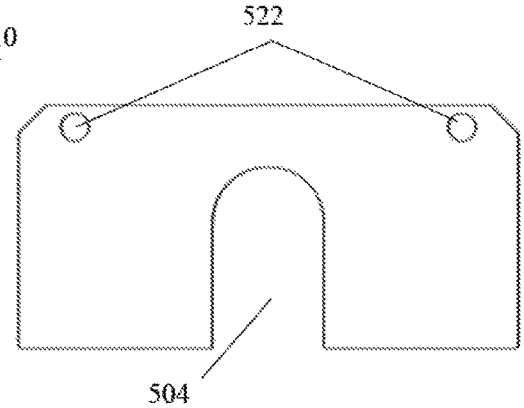
FIG. 5*b* illustrates a front view of the main housing, according to an aspect.
Figure 5C:
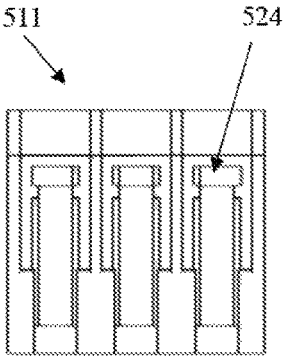
FIG. 5*c* illustrates a right view of the main housing with the three-ammunition opening configuration, according to an aspect.

FIG. 5*b* illustrates a front view of the main housing 102 with both sides having a set of hinge pin holes 522 along with a cutout 504 for access to the interior components, according to an aspect. The hinge pin holes allow for the retention caps 420 to have the ability to be moved from the closed to open position manually.

Figure 5D:
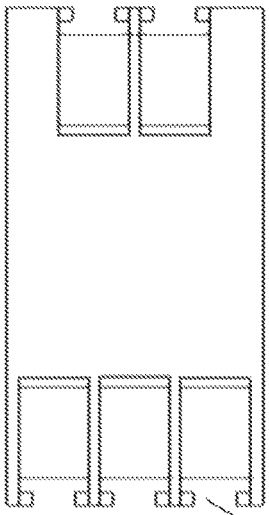
FIG. 5*d* illustrates a top view of the main housing showing the magazine holder mating grooves and retention cap placement, according to an aspect.
Figure 5E:
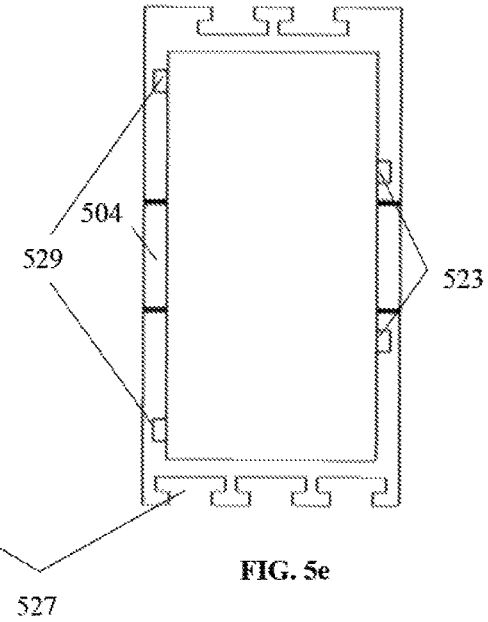
FIG. 5*e* illustrates the bottom view of the main housing showing the set of female thin-span keyways and the set of female wide-span keyways, the magazine holder mating grooves, and the thumb recess, according to an aspect.

FIG. 5*d* illustrates a top view of the main housing 402 showing the female coupling element 527, according to an aspect. The female coupling element 527, such as a groove or slot, have a complementary male coupling element configuration on the magazine holder 103 allowing for the magazine holder 103 to be slid into the main housing 102.

FIG. 5*e* illustrates the bottom view of the main housing 102 showing the set of female thin-span keyways 523 and the set of female wide-span keyways 529, and female coupling element 527, according to an aspect. The two different female keyway configurations permit only correct alignment for inserting the slide housing 101 into the main housing 402.

Figure 5F:
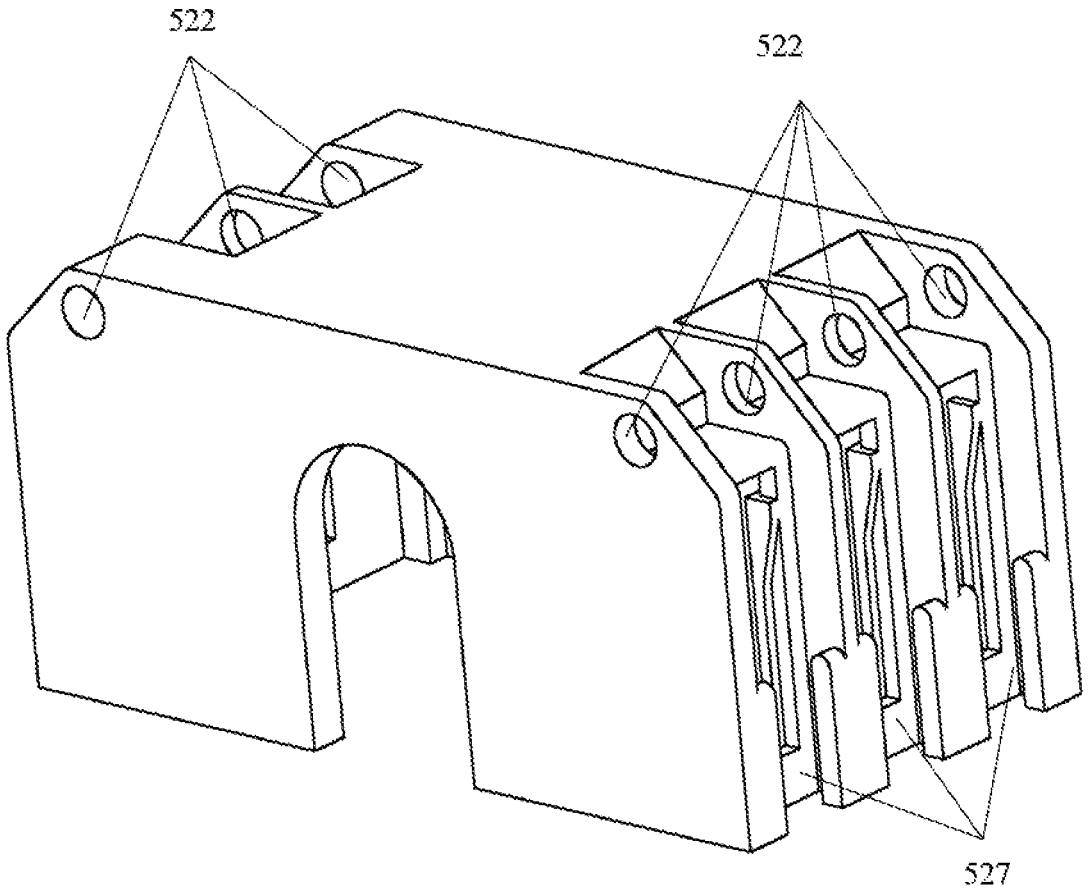
FIG. 5*f* illustrates a perspective view of the main housing, more specifically the mating grooves for securely connecting the main housing to the magazine holder, according to an aspect.

FIG. 5*f* illustrates a perspective view of the main housing 102, more specifically female coupling element 527 for securely connecting the main housing 402 to the magazine holder 103 along with the hinge pin holes 522 for securing the retention caps 420 to the main housing 402, according to an aspect.

FIGS. 6*a*-6*f* illustrate multiple views of the front of a retention cap 620, further showing a lifting lip 652, a protrusion 621, and a hinge pin hole 651, according to an aspect. The retention caps 620 prevent the rounds from exiting the main housing 102 and slide housing 101 assembly, or delivery assembly, prior to the user being ready. The protrusions 621 retain the ammunition within the delivery assembly. The protrusion 621 on the retention caps 620 hold the first round within the slide housing 101 and away from the shear point of where the slide housing 101 meets the main housing 102. The protrusion 621 also limits rattling within the apparatus when holding the first round inside the delivery assembly because the protrusion 621 eliminates the extra space that would allow the rounds to move around in the channel 307. The lifting lip 652 also helps provide a secure connection between the main housing 102 and the slide housing 101. The lifting lip 652 allows for this strong connection because the retention cap 620 swings from the open, or unlocked, position, into the closed, or locked, position, the close position being when the lifting lip 652 is engaged within the slide housing notch. In an example, the angle of the top slanted edge of the retention cap 620 may be at 45 degrees to ensure the retention caps 620 sits flush on a flat surface, which also may keep the lifting lip 652 from obstructing the addition of a new box of rounds to the main housing 102.

The retention caps 620 lock the delivery assembly 981 into a secured position to deter the slide housing 101 and main housing 102 from separating when not desired by the user. It should be noted that the retention caps 620 have a dual function that of securely locking the delivery assembly 981 in place and holding the ammunition within the channels. The retention caps 620 lock the delivery assembly 981 together such as to prevent an accidental opening of the delivery assembly 981, which may lead to the ammunition leaving the delivery assembly 981 and miss firing. In an example, the retention caps 620 may engage with the slide housing 101 via a mechanical lock, such as by a snap-on lock, as known in the art.

Figure 7:
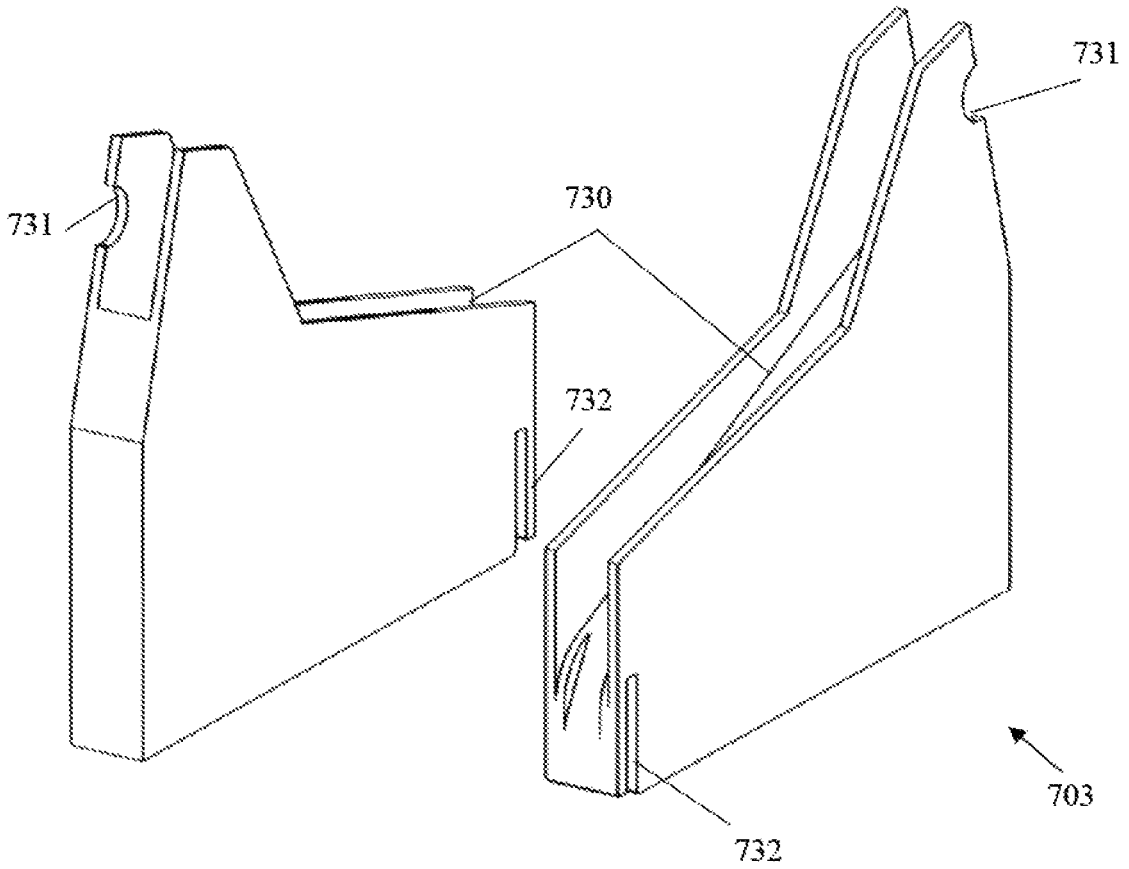
FIG. 7 illustrates the perspective view of the front and back of a magazine holder, according to an aspect.

FIG. 7 illustrates the perspective view of a magazine holder 703, containing a groove 730 running its length for the magazine to be placed in, a circular indent or indentation 731 for the magazine button to be depressed by, and a male coupling element 732 for attaching the magazine holder 703 to the main housing 102, according to an aspect. The magazine holder 703 attaches to the main housing 102 and the slide housing 101 by the male coupling element 732, which ensures a quality connection between the parts of the system and for the bullets to be able to easily slide into the magazine. The magazine holder 730 is set at the optimal angle for the magazine and the main housing ammunition openings to be in line for the ammunition to easily flow from the main housing 102 to the magazine. For example, an optimal angle for the magazine holder may be twenty-five degrees. This groove 730 allows for the magazine to be held within the indentation snuggly so it remains stationary during the loading process. The groove 730 holds the magazine in place while the ammunition is slid into the magazine's opening and the button recess 731 allows for the magazine's button to be held in place for the entire loading process. In an example, the magazine holder can be used with Ruger MK3 and MK4 pistol magazines because of the standard shape.

Figure 8A:
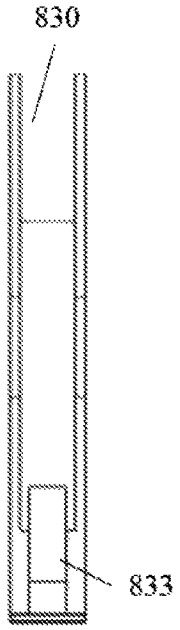
FIG. 8*a* illustrates a front view of a magazine holder device, according to an aspect.
Figure 8B:
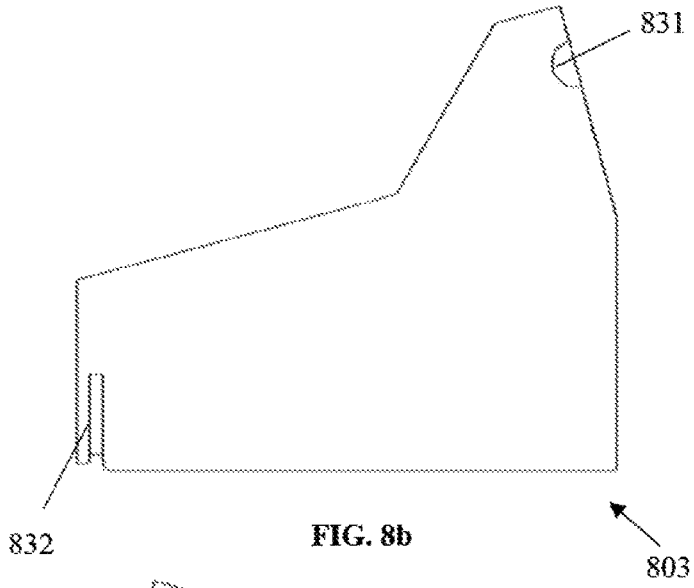
FIG. 8*b* illustrates a right side view of a magazine holder device, according to an aspect.

FIG. 8*a* illustrates a front view of a magazine holder device 803 further showing the groove 830 for holding the magazine and showing the outline of curvature 833 on the magazine holder for transferring rounds from the main housing 102 to the magazine on the magazine holder 803, according to an aspect. This curvature 833 does not occur the entire width of the magazine holder because it allows for just the bullet to be lifted slightly to present it to the magazine opening with as little resistance as possible. FIG. 8*b* illustrates a right side view of a magazine holder device 803 further showing the mating groove 832 for holding the magazine holder 803 to the main housing 102 and the circular indent 831 for depressing the magazine's button, according to an aspect.

Figure 8C:
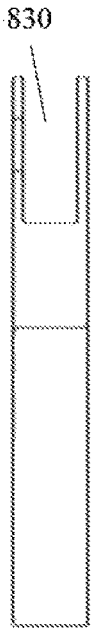
FIG. 8*c* illustrates a back view of a magazine holder device, according to an aspect.
Figure 8D:
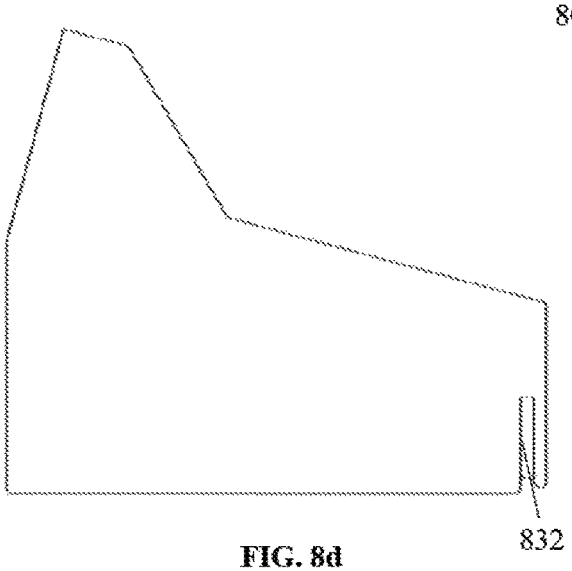
FIG. 8*d* illustrates a left side view of a magazine holder device, according to an aspect.
Figure 8E:
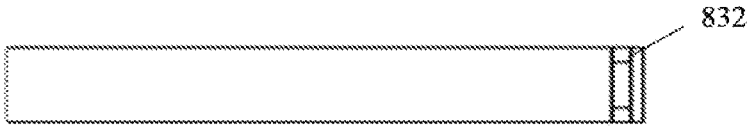
FIG. 8*e* illustrates a bottom view of a magazine holder device further showing the mating hook, for holding the magazine
Figure 8F:
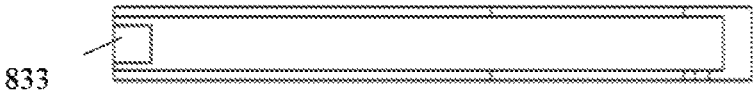
FIG. 8*f* illustrates a top view of a magazine holder device, according to an aspect.

FIG. 8*c* illustrates a back view of a magazine holder 803 further showing the groove 830 for holding the magazine, according to an aspect. FIG. 8*d* illustrates a left side view of a magazine holder device further showing the mating groove 832 for holding the magazine holder 803 to the main housing 102, according to an aspect. FIG. 8*e* illustrates a bottom view of a magazine holder device further showing the mating groove 832, for holding the magazine holder 803 to main housing 102. FIG. 8*f* illustrates a top view of a magazine holder device 803, further showing the curvature 833 on the magazine holder groove 830 for transferring rounds from the main housing 102 to the magazine on the magazine holder 803, according to an aspect.

FIGS. 9*a*-10*b* depict the process of assembling and filling the apparatus for loading a magazine. FIG. 9*a* indicates that the first step of using the apparatus for loading ammunition into a magazine, may be to combine rounds and main housing 902, which is shown in FIG. 9*a*. This may be done by removing the ammunition from the manufacturer's box and placing the main housing deliver box 902 over the rounds that are still contained in the manufacturer's retention packaging. The main housing 902 and rounds are then flipped, and the plastic retention packing is removed. This allows the rounds to be freestanding in the main housing. In an example, the angle of the top slanted edge of the retention cap 620 may be at 45 degrees to ensure the retention caps 620 sits flush with the main housing 902 on a flat surface, which also may keep the lifting lip 652 from obstructing the addition of a new box of rounds to the main housing 102.

Figure 9B:
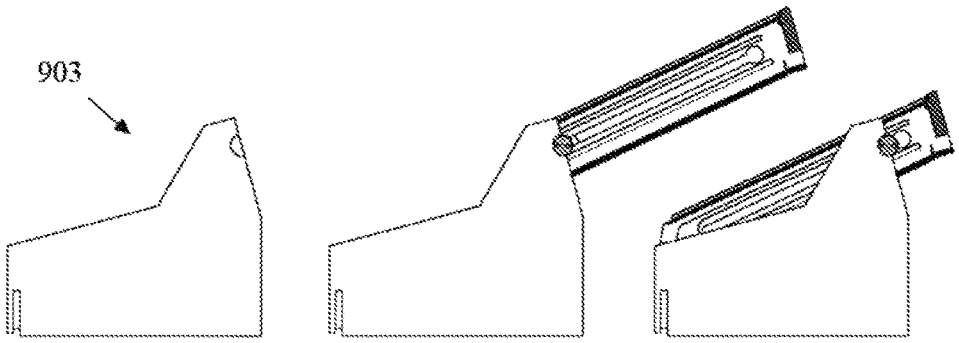
FIG. 9*b* illustrates a side view of the magazine holder being loaded with an empty magazine, according to an aspect.
Figure 9C:
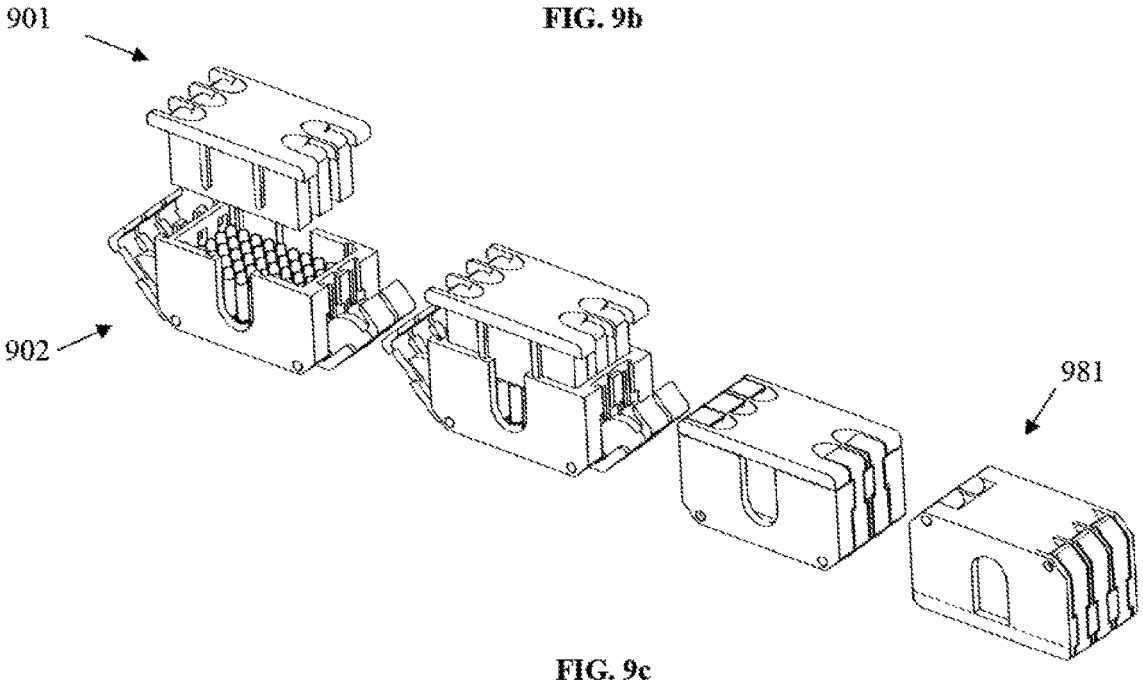
FIG. 9*c* illustrates a perspective view of the slide housing being connected with the main housing, according to an aspect.

Then, the user would insert a magazine into the magazine holder 903 by fitting the magazine into the top groove with the magazine button in line with the circular indentation on the magazine holder 903 and pushing the magazine in place, as shown in FIG. 9*b*. Once this is completed, the user would insert the slide housing 901 into the main housing 902 in the correct orientation. The slide housing 901 may only be inserted, engaged with each other, in the correct orientation due to the keyway and protrusion shapes on both the slide housing 901 and the main housing 902 demonstrated in FIG. 9*c*.

The slide housing 901 and main housing delivery box 902 may be engaged if the orientation of the two parts are correct. The proper engagement is allowed by the correct alignment of the protrusions and keyholes. The previously described wide-span protrusions will align with the wide-span keyholes, while the thin-span protrusions will align with the thin-span keyholes. The two orientation patterns allow for the main housing 902 and slide housing 901 to engage in the proper orientation, allowing for the ammunition exits and ammunition openings to also always be aligned.

A delivery assembly 981 is formed by the slide housing 901 and the main housing 902 becoming engaged with each other, in which the interior walls of the main housing 902 and the exterior walls of the slide housing 901, or mating surfaces, come into contact to form a secure connection with the assistance of the keyholes, protrusions, and retention caps. Once the main housing 902 and slide housing 901 are engaged, the retention caps may move to the closed position and lock onto the slide housing 901. The engagement of the retention caps onto the slide housing 901 allow for a sturdy connection between the main housing 902 and the slide housing 901. In an example, when the delivery assembly 981 is engaged the shape of the retention cap allows for the retention cap to be in the closed position without disturbing the surface the rounds are sitting on within the main housing 902. Also, when putting the retention cap into the closed position the retention caps do not to lift the main housing 902 due to the retention cap moving away from the flat surface in which the delivery assembly 981 is resting on.

This feature further ensures the proper alignment between the slide housing 901 and main housing 902, which allows the bullets to slide into the magazine with the precision necessary. This two-part assembly of the slide housing 901 and the main housing 902, the delivery assembly 981, can also be used to store ammunition in a compact manner, while also storing the unused bullets safely. The delivery assembly 981 could also be used for temporarily storing, or containing, the ammunition. In an example to test the vertical force, the loading apparatus, when filled, can be stood on by a grown man weighing in excess of 100 kg and the container will still exert no pressure to the rounds inside, which means the round will not unintentionally discharge.

Figure 10A:
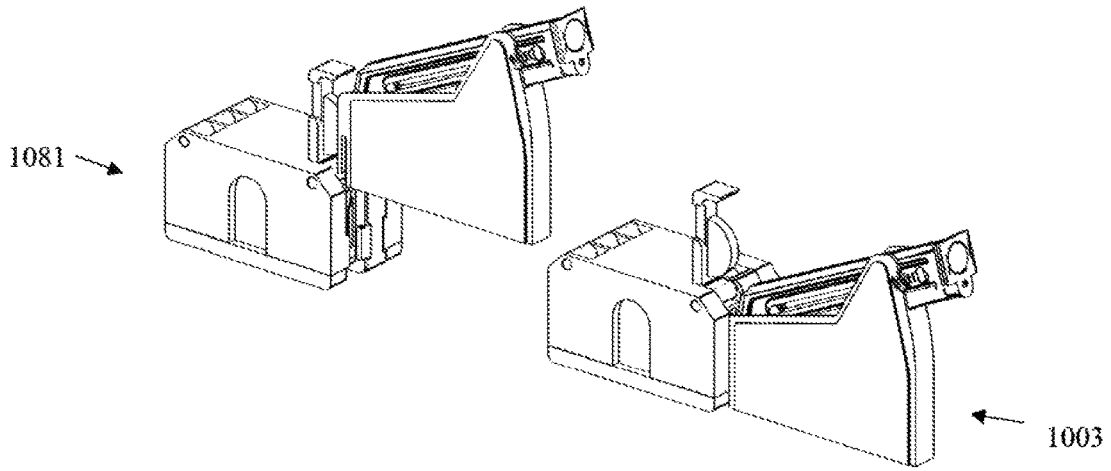
FIG. 10*a* illustrates a perspective view of the main housing and slide housing system being combined with the magazine holder and empty magazine, according to an aspect.
Figure 10B:
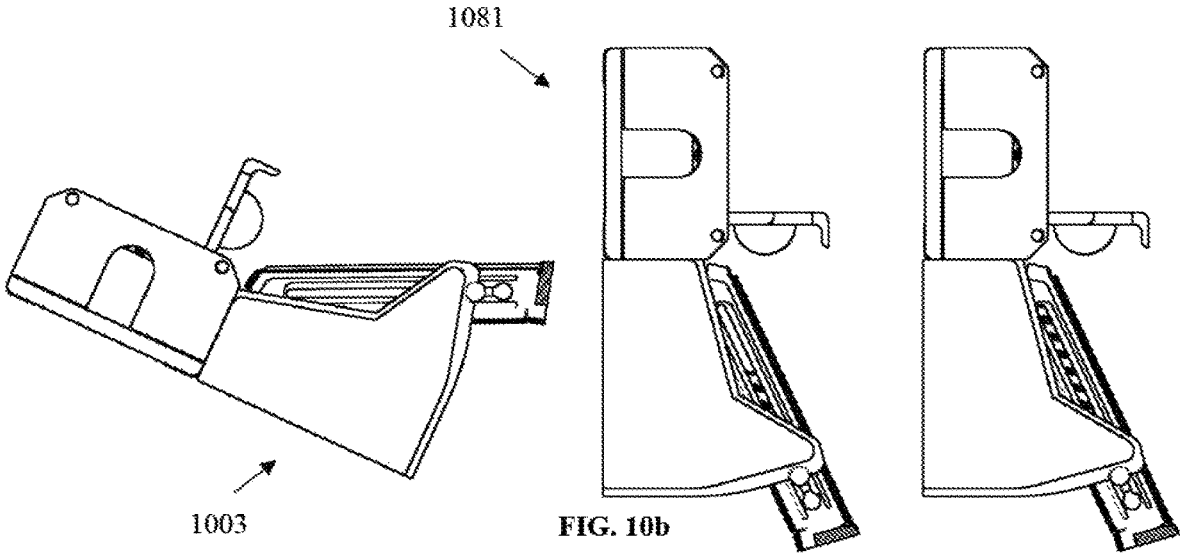
FIG. 10*b* illustrates a side view of the entire system being rotated to allow for the ammunition to slide into the empty magazine, according to an aspect.

FIG. 10*a* illustrates a perspective view of the delivery assembly 1081 being combined with the magazine holder 1003 and empty magazine, according to an aspect. FIG. 10*b* illustrates a side view of the entire system being rotated to allow for the ammunition to slide into the empty magazine, according to an aspect. As shown, the main housing retention cap can be lifted and the slot side of the magazine holder, with the magazine inserted, would be slid into the delivery assembly 1081 shown in FIG. 10*a*. The magazine holder's hook and male coupling element would slide into the notch on the slide housing 1001 and female coupling element on the main housing 1002 to operationally engage the components. With apparatus fully assembled, the user would turn the system for the rounds to exit the main housing 1002 into the empty magazine. In an example, the user would turn the apparatus ninety degrees to allow the ammunition to slide from the delivery assembly into the magazine.

Next, the user would remove the magazine from the magazine holder 1003 and have a fully loaded and ready for insertion magazine, as shown in FIG. 10*b*. As described before, in an example, the device allows the loading of five magazines, each magazine having a ten-round capacity, within thirty seconds and then allowing the loader to be ready to be used again within a ten-second window.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A magazine ammunition loading apparatus comprising:

a slide housing having a zig zag patterned ammunition holding configuration, wherein a plurality of channels are located adjacent to each other and configured to hold ammunition, wherein three of the channels have ammunition exits on a left side of the slide housing and two of the channels have ammunition exits on a right side of the slide housing;

a main housing adapted to fit and mate with the slide housing, the main housing having a plurality of ammunition openings corresponding with the plurality of channels, wherein the ammunition openings are covered by retention caps; and a magazine holder having a groove for holding an empty magazine, the magazine holder having an indentation configured for engaging a magazine button when the magazine is slid into the groove.

2. The magazine ammunition loading apparatus of claim 1, wherein the slide housing comprises:

a plurality of male protrusions, a wide-span set and a thin-span set, the male protrusions being protruded from front and back exterior walls of the slide housing allowing the slide housing to fit into the main housing;

the plurality of ammunition exits allowing the round of ammunition to exit the apparatus with minimal contact between the lead portion of the round of ammunition and the slide housing; and a plurality of notches on the slide housing below each channel, wherein each notch allows for the retention caps and the slide housing to be engaged.

3. The magazine ammunition loading apparatus of claim 1, wherein the main housing comprises:

a plurality of female keyholes on both the front and back interior walls, which mirror the configuration on the slide housing;

the plurality of ammunition openings having a rail, which allows the round of ammunition to rest on its rim, and a slot allowing the round of ammunition to exit the main housing with minimal contact between the lead portion of the round of ammunition and the main housing;

a thumb recess cutout on both the front and back walls for access to the slide housing;

five retention cap cutouts, having three retention cap cutouts on the left side and two retention caps on the right side;

a plurality of hinge pin holes that run through the retention cap cutouts on each the left and right side allowing for the pivotal connection between the retention caps and the main housing by using a hinge pin;

the five retention caps having a hinge pin hole for securing them to the main housing, a protrusion to snugly fit into the ammunition openings to retain the rounds within the delivery assembly, and a lifting lip to allow the user to lift the retention cap from a closed position to a open position; and a female coupling element that the magazine holder engages with.

4. The magazine ammunition loading apparatus of claim 1, wherein the magazine holder comprises:

a male coupling element to engage with the main housing.

5. A magazine ammunition loading apparatus comprising:

a slide housing having a staggered ammunition holding configuration, a plurality of channels with several of the channels having ammunition exits on one side of the slide housing with the remaining plurality of the channels having ammunition exits on the opposite side of the slide housing;

a main housing that mates with the slide housing, the main housing having a plurality of ammunition openings, wherein the ammunition openings are selectively closed by retention caps; and a magazine holder having a groove for holding an empty magazine, the magazine holder having an indentation configured to engage a magazine button when the magazine is slid into the groove.

6. The magazine ammunition loading apparatus of claim 5 wherein the slide housing has five parallel channels with ammunition exits and two ammunition exits are on one side and three ammunition exits are on the opposite side.

7. The magazine ammunition loading apparatus of claim 5 wherein the slide housing comprises:

a plurality of male protrusions being protruded, in parallel, from front and back exterior walls allowing the slide housing to fit into the main housing; and a plurality of notches on a bottom plate corresponding to each channel, the notches allow for a retention cap to be placed inside to form a strong engagement between the main housing and the slide housing.

8. The magazine ammunition loading apparatus of claim 5 wherein the main housing comprises:

a plurality of ammunition openings having a rail, which allows a round of ammunition to rest on its rim, and a slot, which allows the round of ammunition to exit a delivery assembly with minimal contact between the lead portion of the round of ammunition and the delivery assembly;

a plurality of thumb recess cutouts on both front and back of the main housing;

a plurality of hinge pin holes that run through the retention cap cutouts on each left and right side allowing for the operational engagement of the retention caps and the main housing.

9. The magazine ammunition loading apparatus of claim 5 wherein the main housing has a plurality of female keyholes on both the front and back interior walls, which mirror the configuration on the slide housing allowing the main housing and the slide housing to engage.

10. The magazine ammunition loading apparatus of claim 5 wherein the main housing comprises:

five ammunition openings with corresponding female coupling elements, the ammunition openings having two on one side and three on the opposite side;

a plurality of retention caps that are pivotally engaged to the main housing and that correspond to the ammunition openings;

wherein the retention caps on the main housing have a protrusion for snugly fitting into the ammunition openings; and wherein each retention cap has a lifting lip, which allows the user to lock the main housing to the slide housing and to lift the retention cap from its closed and locked position to its open and unlocked position.

11. The magazine ammunition loading apparatus of claim 5 wherein the magazine holder comprises:

a male coupling element to engage with each of a main housing female coupling elements.

12. A magazine ammunition loading apparatus comprising:

a slide housing having a plurality of channels for containing ammunition, the slide housing having several channels having ammunition exits on one side and the remaining channels having ammunition exits on the opposite side of the slide housing;

a main housing that mates with the slide housing to form a delivery assembly, the main housing has a plurality of ammunition openings corresponding to the ammunition exits of the slide housing; and a plurality of retention caps adapted to lock the main housing onto the slide housing and the plurality of retention caps adapted to temporarily contain the ammunition within the plurality of channels and within the delivery assembly; and wherein the delivery assembly is adapted to operationally engage a magazine holder.

13. The magazine ammunition loading apparatus of claim 12 further comprising the magazine holder holds a magazine in place during loading of the ammunition from the delivery assembly into the magazine.

14. The magazine ammunition loading apparatus of claim 13 wherein the magazine holder has an indentation configured to engage a magazine button when the magazine is slid into the magazine holder, thus preparing the magazine to receive the ammunition.

15. The magazine ammunition loading apparatus of claim 12 wherein the slide housing and the main housing engage each other such that the ammunition exits, and the ammunition openings are aligned.

16. The magazine ammunition loading apparatus of claim 12 wherein the slide housing and the main housing engage each other by a pair of matching keyhole and protrusion.

17. The magazine ammunition loading apparatus of claim 12 wherein the retention caps have protrusions that fit snuggly into the ammunition openings of the main housing to assist with retaining the ammunition within the plurality of channels.

18. The magazine ammunition loading apparatus of claim 12 wherein the retention caps and the main housing are pivotally engaged to allow selective opening of the retention caps and thus allowing the ammunition to exit from the plurality of channels.

19. The magazine ammunition loading apparatus of claim 12 wherein the main housing has a female coupling element associated with each ammunition opening that engages a corresponding male coupling element associated with a magazine holder.

* * * * *